US007162753B2

(12) United States Patent
Khosropour et al.

(10) Patent No.: US 7,162,753 B2
(45) Date of Patent: Jan. 16, 2007

(54) APPARATUS FOR DIRECTING AIR TOWARD A BATHER

(75) Inventors: M. Michael Khosropour, Madison, WI (US); Faustino D. Gamulo, Jr., Vallejo, CA (US); Scott M. Sanford, Concord, CA (US); Jim R. Pauls, Concord, CA (US)

(73) Assignee: Jacuzzi, Inc., West Palm Beach, FL (US)

( * ) Notice: Subject to any disclaimer, the term of this patent is extended or adjusted under 35 U.S.C. 154(b) by 359 days.

(21) Appl. No.: 10/929,974

(22) Filed: Aug. 30, 2004

(65) Prior Publication Data

US 2005/0150041 A1 Jul. 14, 2005

Related U.S. Application Data

(60) Provisional application No. 60/535,872, filed on Jan. 12, 2004.

(51) Int. Cl.
*A47K 3/02* (2006.01)

(52) U.S. Cl. ..... 4/546; 4/559

(58) Field of Classification Search ..... 4/524, 4/546, 559; 132/271; 34/96–98
See application file for complete search history.

(56) References Cited

U.S. PATENT DOCUMENTS

| | | | |
|---|---|---|---|
| 4,858,255 | A | 8/1989 | Haisman |
| 4,901,379 | A | 2/1990 | Chalberg et al. |
| 5,099,587 | A | 3/1992 | Jarosch |
| 6,131,212 | A | 10/2000 | Lang |
| 6,155,801 | A | 12/2000 | Elnar |
| 6,317,903 | B1 | 11/2001 | Brunelle et al. |
| 6,581,217 | B1 | 6/2003 | Marcos |

FOREIGN PATENT DOCUMENTS

| | | |
|---|---|---|
| WO | W0 91/16029 | 10/1991 |

*Primary Examiner*—Robert M. Fetsuga
(74) *Attorney, Agent, or Firm*—Thomas R. Lampe

(57) ABSTRACT

Apparatus for directing in air flow toward the face or other body area of a bather includes a housing connected to the bathing tub and an air nozzle movable relative to the housing between a retracted position and an extended position.

14 Claims, 5 Drawing Sheets

APPARATUS FOR DIRECTING AIR TOWARD A BATHER

This application is based on and claims the benefit of U.S. Provisional Patent Application No. 60/535,872, filed Jan. 12, 2004.

TECHNICAL FIELD

This invention relates to apparatus operatively associated with a bathing tub for directing an air flow toward the face or other upper body area of a bather in the bathing tub.

BACKGROUND OF THE INVENTION

Many bathers would like to stay in a bathing tub for an extended period of time when taking a hot bath. However, this can become very hot and uncomfortable.

It is known generally to provide directional air vents for spas, jetted bathtubs and other types of bathing tubs, including arrangements for providing flowing air above the water line to a bather. Such arrangements are shown in U.S. Pat. No. 6,317,903, issued Nov. 20, 2001, and U.S. Pat. No. 6,581,217, issued Jun. 24, 2003.

It is also known to direct air to an individual in a cabinet not containing water. This approach is exemplified in U.S. Pat. No. 5,099,587, issued Mar. 31, 1992, and in International Publication No. WO 91/16029, published Oct. 31, 1991.

And of course, it is well known to employ air blowers in association with underwater jets or nozzles. Typical examples of this approach are shown in U.S. Pat. No. 6,131,212, issued Oct. 17, 2000, U.S. Pat. No. 4,901,379, issued Feb. 20, 1990, U.S. Pat. No. 4,858,255, issued Aug. 22, 1989 and U.S. Pat. No. 6,155,801, issued Dec. 5, 2000.

No prior art devices are known which teach or suggest the unique combination of structural elements disclosed and claimed herein.

DISCLOSURE OF INVENTION

The present invention relates to apparatus for delivering air flow toward the face or other upper body area of a bather that is characterized by its relative simplicity and ease of use. The apparatus is employed in association with a bathing tub and can be conveniently actuated or deactuated. When the apparatus is actuated, one or more air nozzles thereof are positioned well above the top of the rim of the bathing tub so that the air can be directed in a proper direction toward even tall bathers. The apparatus may be disposed conveniently out of the way when not in use so that it does not create an obstruction which could cause one to fall or be injured when entering or leaving the bathtub.

The direction of air flow can be conveniently and readily adjusted. A screen filter is incorporated in the apparatus to prevent particulates from hitting one's face and the apparatus may be readily disassembled for maintenance, cleaning or other purposes.

The apparatus includes an air nozzle defining at least one air exit opening. A housing is connected to a bathing tub defining a housing interior and a top opening communicating with the housing interior. The air nozzle extends downwardly through the top opening into the housing interior and is slidably movable relative to the housing between an extended or upper position and a retracted or lower position.

An air blower is provided for directing air to the air nozzle and out of the at least one exit opening. A control is employed for selectively turning the air blower on or off.

Other features, advantages and objects of the present invention will become apparent with reference to the following description and accompanying drawings.

BEST MODE FOR CARRYING OUT THE INVENTION

Figure 1:
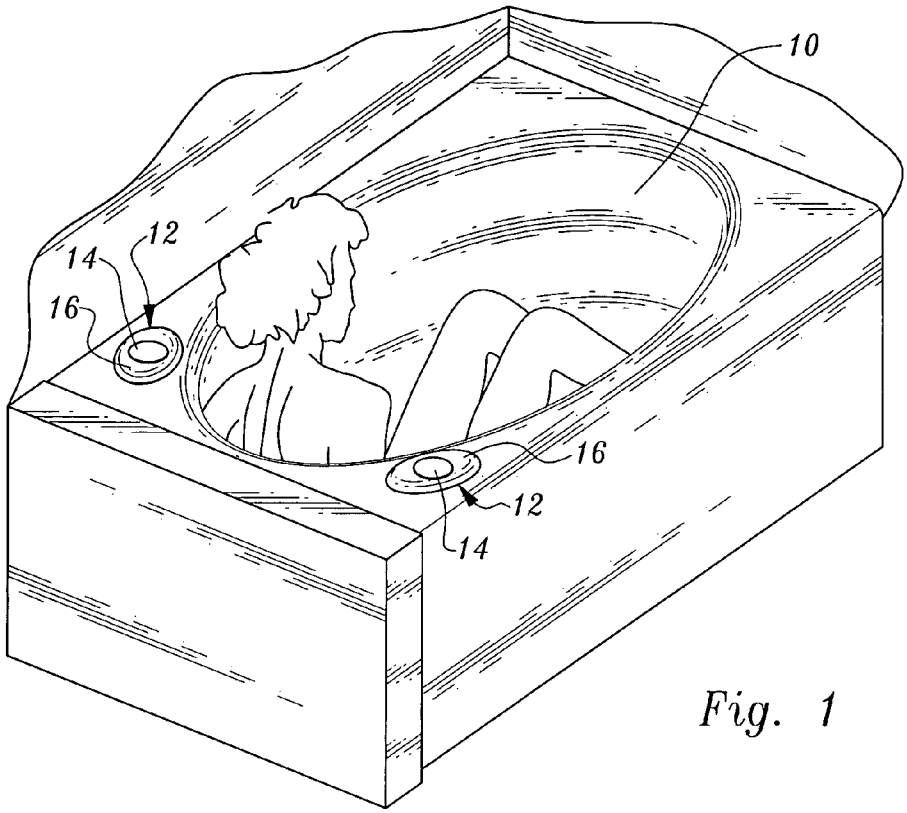
FIG. 1 is a perspective view of a bathtub occupied by a bather and illustrating two identical apparatus constructed in accordance with the teachings of the present invention in retracted or down position.
Figure 2:
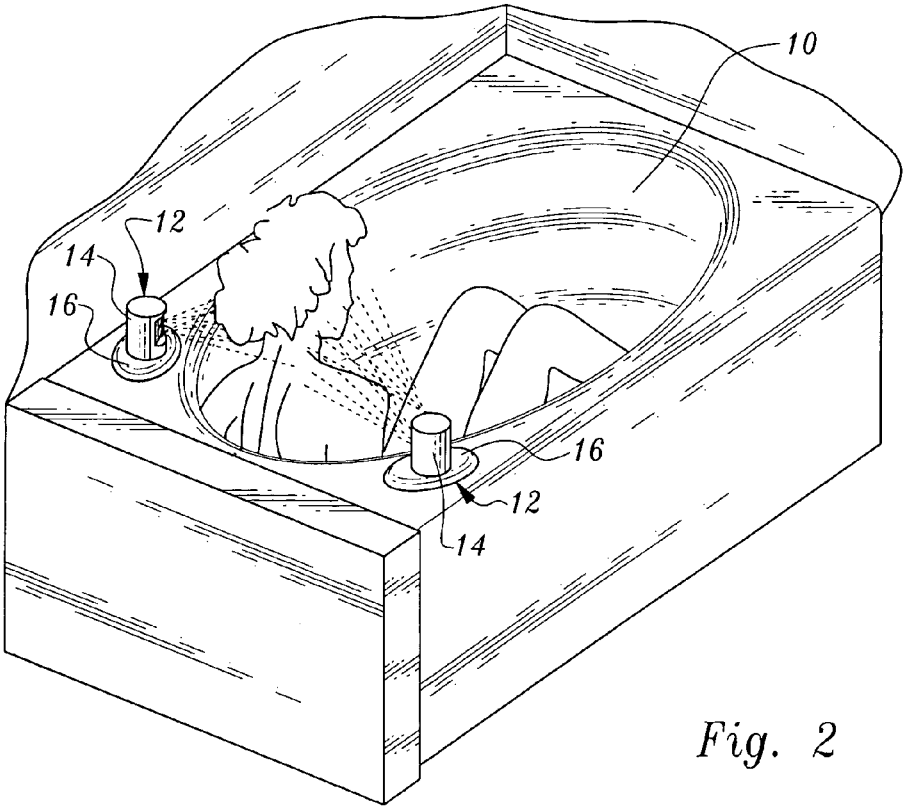
FIG. 2 is a view similar to FIG. 1, but illustrating the apparatus in extended or up position and delivering a flow of air to the head and face of the bather.
Figure 3:
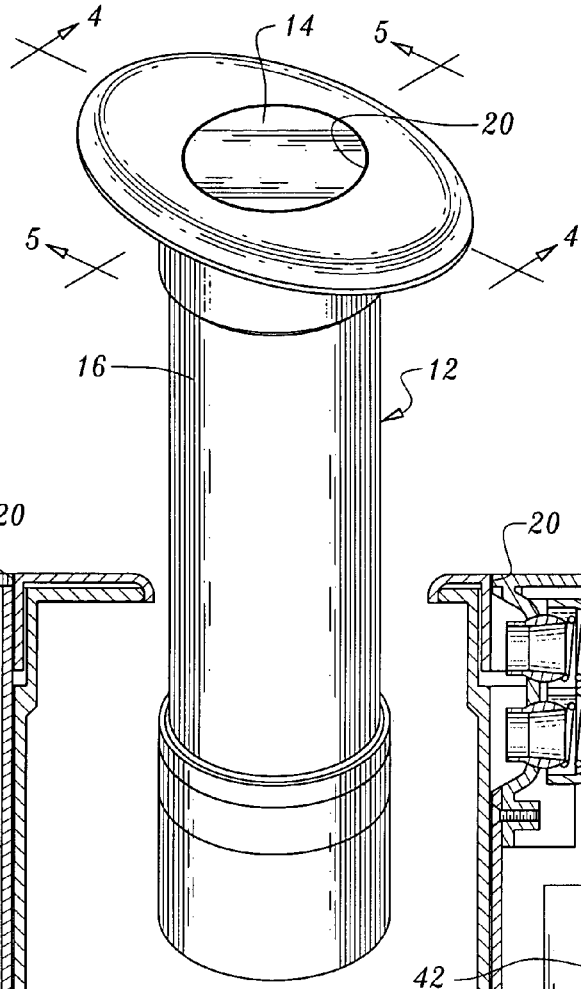
FIG. 3 is a greatly enlarged, perspective view of a preferred embodiment of the apparatus, the air nozzle being in retracted or down position.
Figure 4:
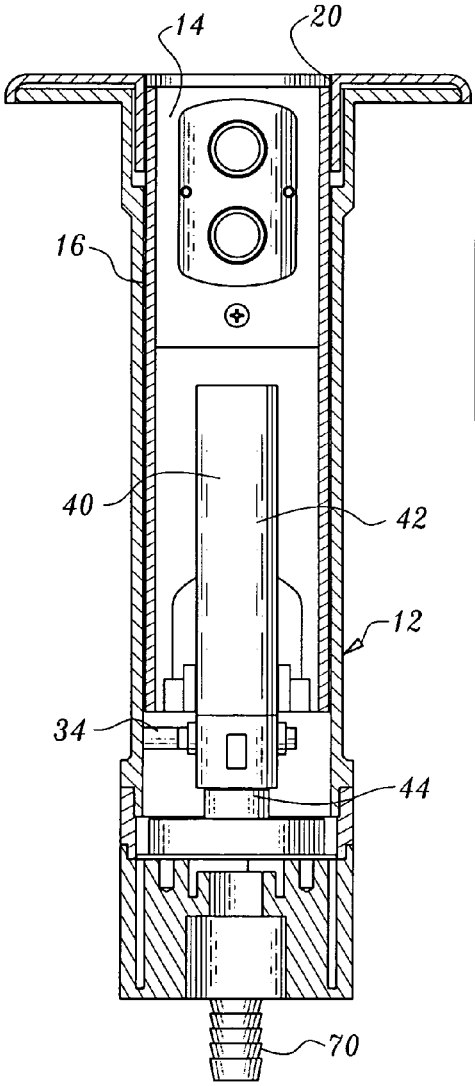
FIG. 4 is a cross-sectional view taken along the line 4—4 in FIG. 3.
Figure 5:
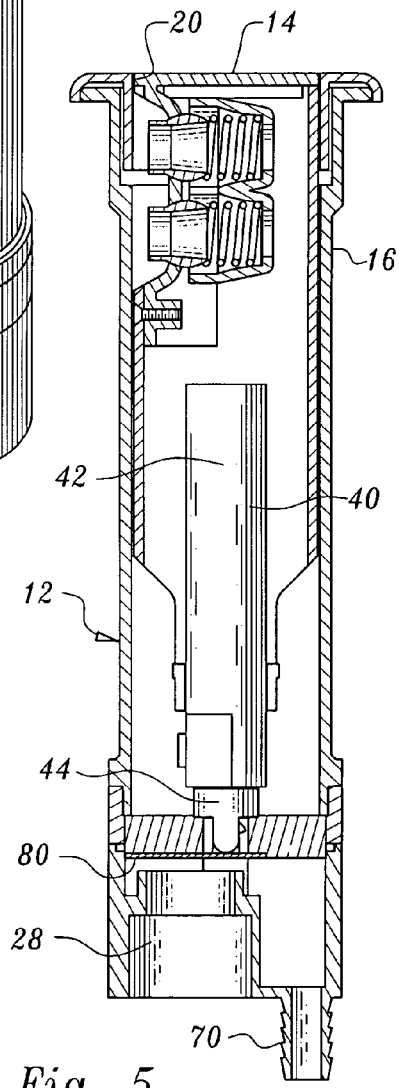
FIG. 5 is a cross-sectional view taken along the line 5—5 in FIG. 3.
Figure 7:
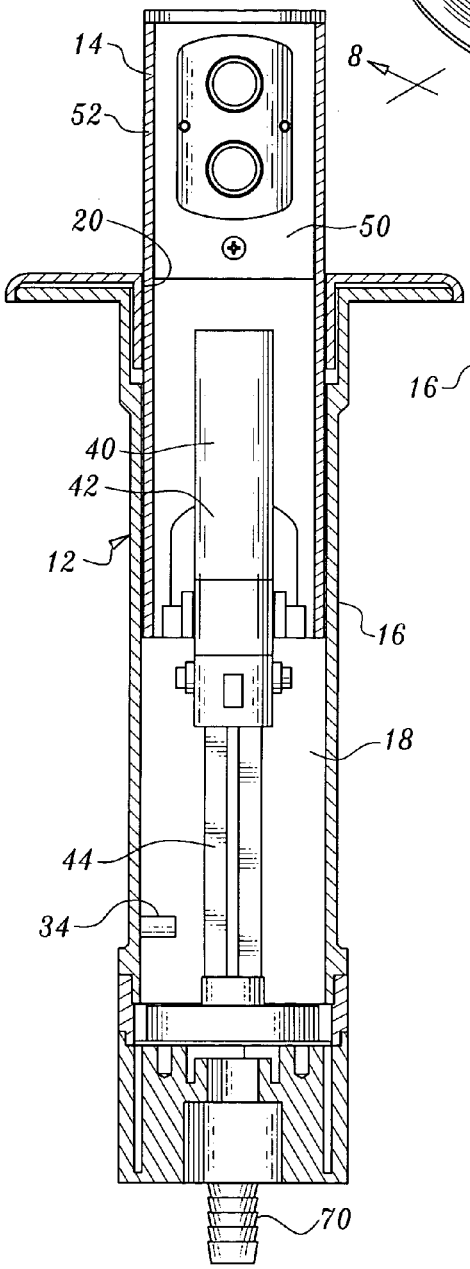
FIG. 7 is a cross-sectional view taken along the line 7—7 in FIG. 6.
Figure 6:
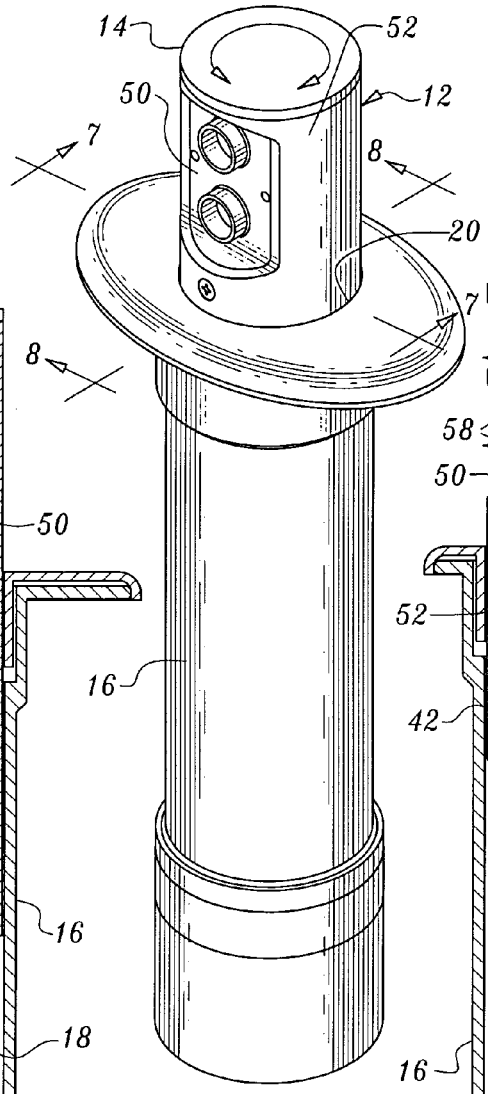
FIG. 6 is a view similar to FIG. 3, but illustrating the air nozzle in extended or up position.
Figure 12:
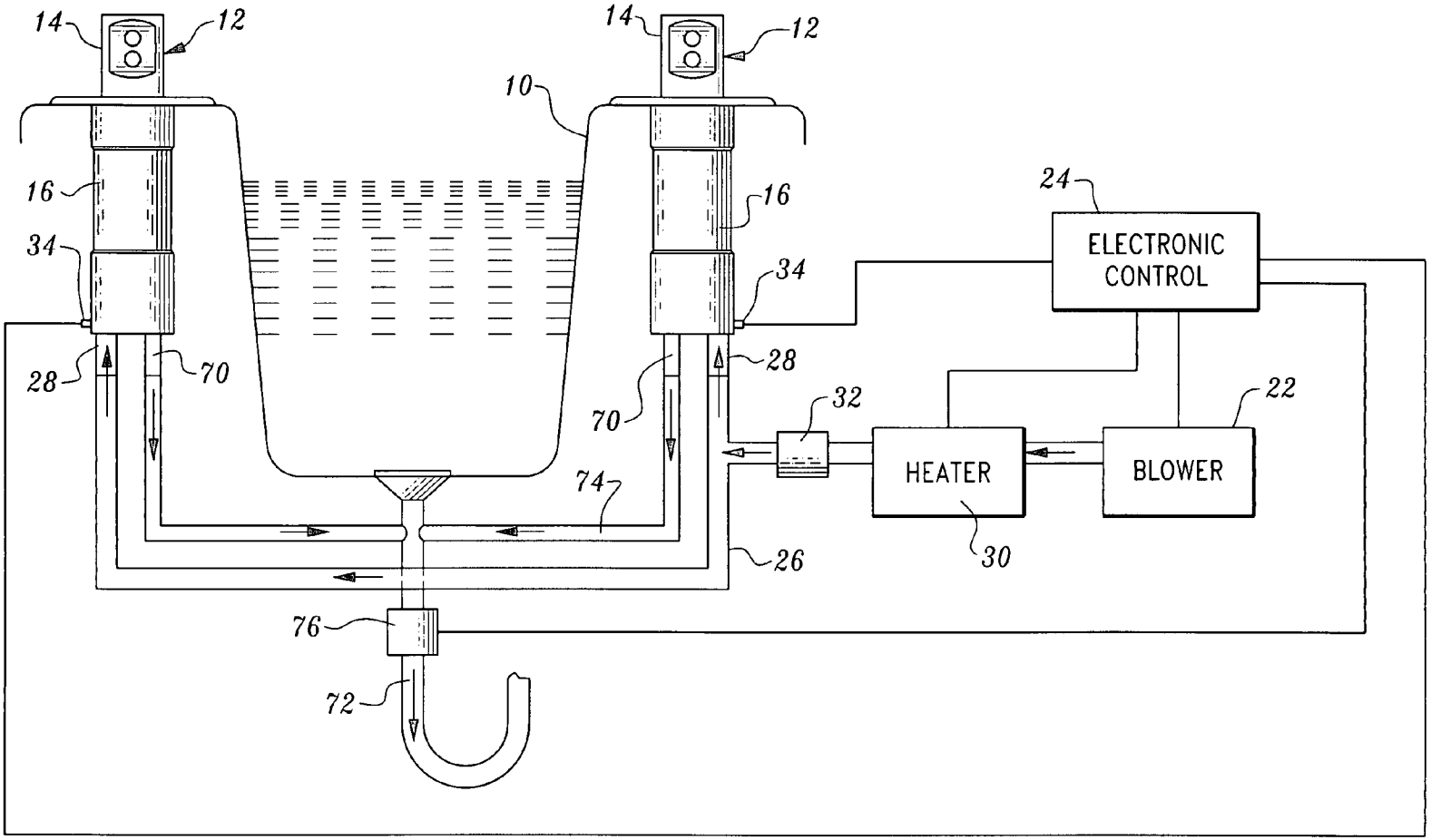
FIG. 12 is a diagrammatic view illustrating two apparatus associated with a bathtub with the air nozzles in extended position and other components of the invention operatively associated therewith.

FIGS. 1, 2 and 12 illustrate a bathing tub in the form of a conventional bathtub 10 with which the apparatus of the present invention is operatively associated. FIGS. 1 and 2 show a bather in position in the tub interior. Apparatus constructed in accordance with the teachings of the present invention is operatively associated with the bathtub for directing an air flow toward the face or other upper body area of the bather.

As will be described in greater detail below, the apparatus includes an air nozzle/housing sub-assembly. There are two such sub-assemblies employed with bathtub 10 and each has been designated by reference numeral 12. In FIGS. 1 and 3–5, the air nozzle 14 of the sub-assembly is in a retracted or down position, with the air nozzle essentially flush with the upper surface of the bathtub. In FIGS. 2, 6–8 and 12, on the other hand, the air nozzle 14 is in its extended or up position.

It will be appreciated that the air nozzle/housing sub-assemblies 12 are of identical configuration, so the description of a single sub-assembly which follows will be applicable to both.

The housing 16 of the device is connected to the bathing tub and defines a housing interior 18 and a top opening 20 communicating with the housing interior. The air nozzle 14 extends downwardly through the top opening 20 into the housing interior 18 and is slidably movable relative to the housing between the extended position and the retracted position.

Referring now particularly to FIG. 12, a blower 22 controlled by control 24 delivers a flow of air through conduit 26 to air lines 28 into the housing interior 18. If desired, a heater 30 is located between the blower and the sub-assemblies 12. The heater is controlled by controller 24 to heat the air flow to a desired temperature. A check valve 32 prevents back flow of water to the heater/blower. A switch 34 of any suitable type is operatively associated with the air nozzle and housing and the control 24. When the air nozzle is in its retracted position the switch causes the control to deactivate the blower and heater.

The apparatus includes manually actuable air nozzle positioning structure operatively associated with the air nozzle for moving the air nozzle from its retracted position to its extended position. In the arrangement illustrated, the air nozzle positioning structure comprises an air damper assembly 40 with piston seal and piston rod latch for controlling the movement of the air nozzle to its extended position from its retracted position responsive to application of a downward manual force on the retracted air nozzle. A suitable device of this nature is disclosed in U.S. Pat. No. 5,518,223, issued May 21, 1996.

Air damper assembly or air nozzle positioning structure 40 has an upper component 42 and a lower component 44, the upper component slidably receiving and mounted on the lower component. The upper component 42 is secured to the air nozzle 14 and the lower component 44 is secured to the housing. The air nozzle positioning structure biases the air nozzle toward its extended or up position, with the latch thereof (not shown) maintaining the air nozzle in the retracted position after a downward manual force has moved the air nozzle to its retracted position from its extended position until a subsequent downward manual force is applied to the air nozzle. The subsequent downward manual force releases the latch of the air nozzle positioning structure and moves the air nozzle to its extended or up position.

Figure 9:
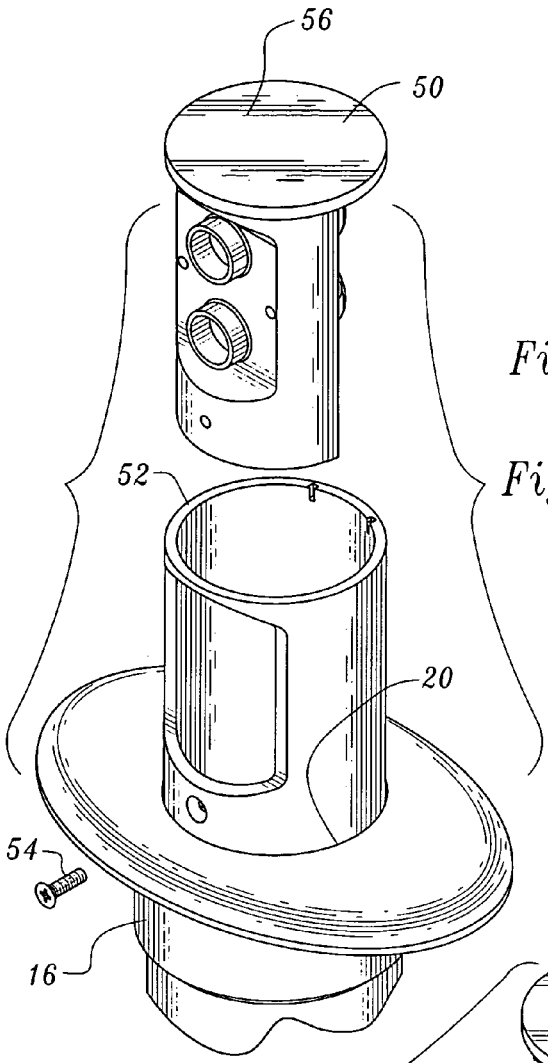
FIG. 9 is an exploded, perspective view illustrating the extended air nozzle partially disassembled.
Figure 10:
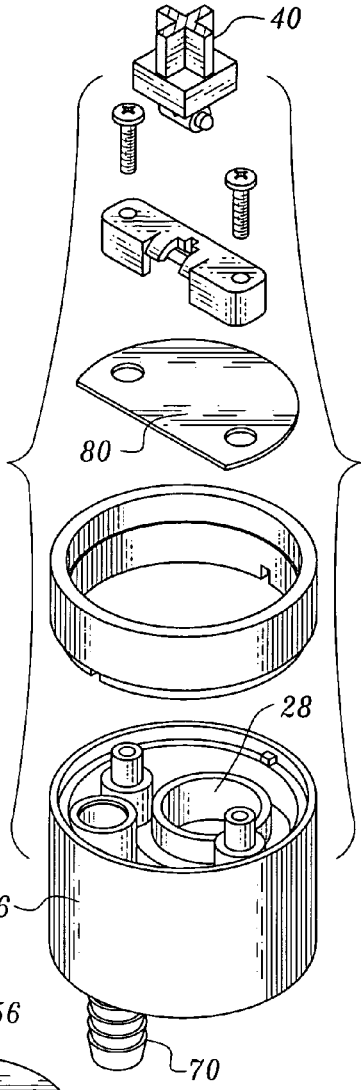
FIG. 10 is a perspective, exploded view illustrating components of the apparatus housing and a portion of the air nozzle positioning structure of the apparatus.

The air nozzle 14 includes inner nozzle portion 50 and outer nozzle portion 52. A threaded fastener 54 is employed to maintain the inner and outer nozzle portions connected together. When the threaded fastener is unscrewed, the inner nozzle portion may be completely removed from the outer nozzle portion as shown in FIG. 9. This provides access to the inner components of the air nozzle.

The inner nozzle portion 50 has a top cap 56 utilized to initiate extension or retraction of the air nozzle.

Figure 11:
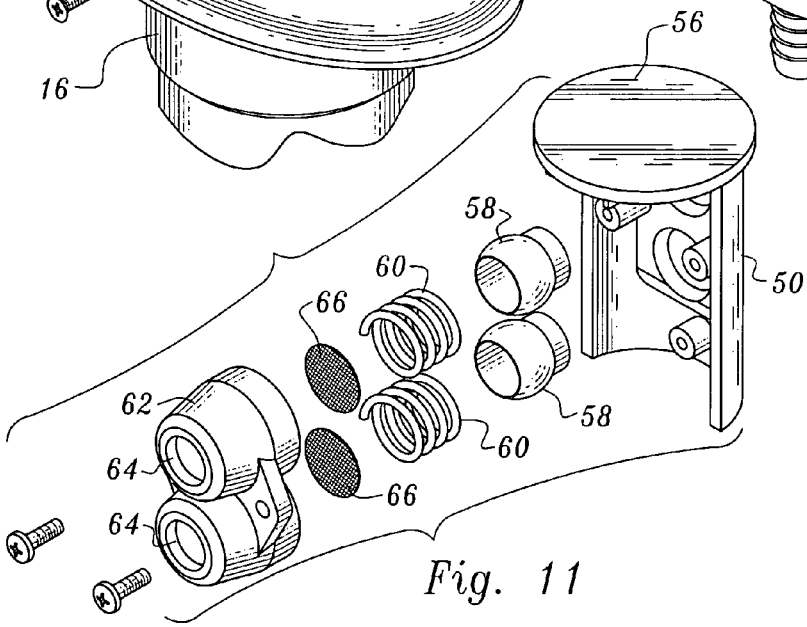
FIG. 11 is a perspective, exploded view illustrating structural elements of one of the air nozzle components.

FIG. 11 shows the back side of inner nozzle portion 50. The air nozzle includes two adjustably positionable nozzle elements or jets 58 defining air exit openings. The nozzle elements 58 are seated in apertures formed in the front face of the inner nozzle portion. Compression springs 60 bias the nozzle elements outwardly. A mounting member 62, which is hollow and has apertures 64 communicating with the interior of the mounting member, is screwed into place, retaining the springs 60 in position so that the nozzle elements are positioned properly.

Air flow through apertures 64 proceeds out of the nozzle elements. Filter screens 66 are disposed in mounting member 62 between apertures 64 and the nozzle elements to prevent any particulate matter from exiting the air nozzle and striking a bather. The screens and other components of the inner nozzle portion can be readily replaced or maintained due to the fact that the inner nozzle portion can be completely separated from the outer nozzle portion.

Figure 8:
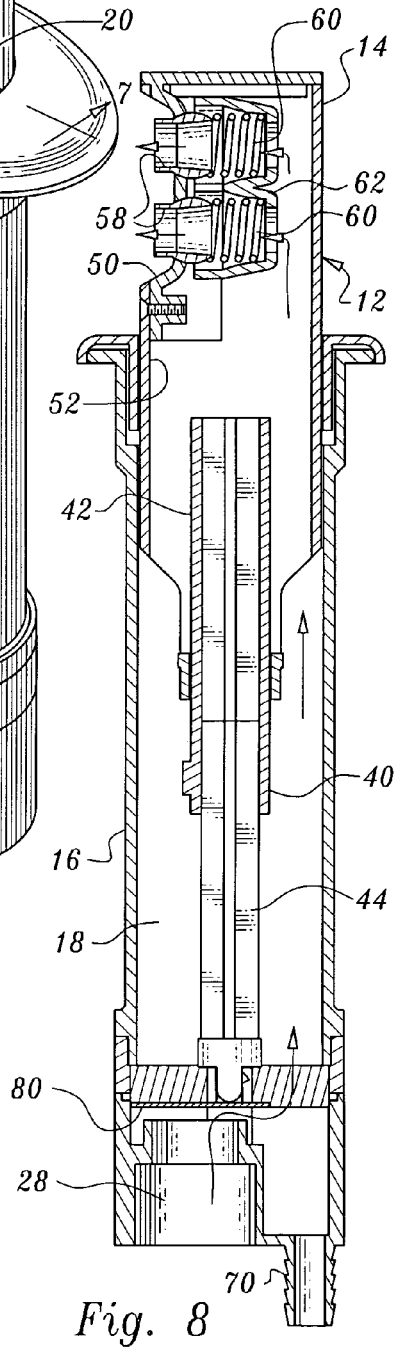
FIG. 8 is a cross-sectional view taken along the line 8—8 in FIG. 6.

In FIG. 8 arrows depict the air flow from air line 28 into the housing interior and outwardly through the nozzle elements 58 when the air nozzle is in its extended or up position. The direction of the flow out of the air nozzle may be adjusted by rotating the air nozzle about the vertical axis it shares with the housing and also by changing the orientations of the nozzle elements.

Extending downwardly from the bottom of the housing 16 and having an interior in communication with the interior of the housing is a water drain outlet 70. As can be seen in FIG. 12, the water drain outlet 70 is connected to a tub drain 72 by a conduit 74. A solenoid operated valve 76 connected to the tub drain prevents air from the air nozzle and housing from entering the tub drain. When the air flow into the air nozzle and housing is turned off, the control 24 opens the solenoid 76 allowing any water in the air/nozzle assembly to drain away.

A diverter plate 80 is located within the interior of the housing over the outlet of air line 28. This directs any water in the air nozzle/housing subassembly to the water drain outlet 70 and keeps the air line free of moisture.

The invention claimed is:

1. Apparatus operatively associated with a bathing tub for directing an air flow toward the face or other upper body area of a bather in the bathing tub, said apparatus comprising, in combination:

an air nozzle defining at least one air exit opening;

a housing connected to said bathing tub defining a housing interior and a top opening communicating with said housing interior, said air nozzle extending downwardly through said top opening into said housing interior and slidably movable relative to said housing between an extended position and a retracted position;

an air blower for directing air to said air nozzle and out of said at least one exit opening; and a control for selectively turning said air blower on or off.

2. The apparatus according to claim 1 wherein said control includes a switch operatively associated with said air nozzle and housing to turn off said air blower when said air nozzle is moved to said retracted position.

3. The apparatus according to claim 1 additionally comprising manually actuable air nozzle positioning structure operatively associated with said air nozzle for moving said air nozzle from said retracted position to said extended position.

4. The apparatus according to claim 3 wherein said air nozzle positioning structure biases said air nozzle toward said extended position and includes a latch maintaining said air nozzle in said retracted position after a downward manual force has moved said air nozzle to said retracted position from said extended position until a subsequent downward manual force is applied to said air nozzle, said subsequent downward manual force releasing said latch and enabling said air nozzle to move to said extended position.

5. The apparatus according to claim 3 wherein said air nozzle positioning structure comprises an air damper assembly with piston seal and piston rod latch for controlling the movement of said air nozzle to said extended position from said retracted position responsive to application of said subsequent downward manual force to said air nozzle.

6. The apparatus according to claim 1 wherein said air nozzle and said housing are disposed along a common axis, said air nozzle rotatable relative to said housing about the common axis to change the direction of air exiting said one or more air exit openings.

7. The apparatus according to claim 1 additionally comprising a heater for heating air directed to said air nozzle by said air blower.

8. The apparatus according to claim 1 wherein said housing defines an air flow passageway receiving air flow from an air line delivering air from said air blower and directing air received from said air line to said air nozzle, said apparatus including a deflector for deflecting any water entering either the air nozzle or housing away from said air line.

9. The apparatus according to claim 8 additionally comprising a water drain extending downwardly from said housing for receiving water deflected by said deflector.

10. The apparatus according to claim 9 wherein a tub drain extends downwardly from said bathing tub, said water drain being in fluid-flow communication with said tub drain.

11. The apparatus according to claim 10 additionally comprising a valve operable to prevent water flow from said water drain to said tub drain responsive to air flow from said blower to said air nozzle.

12. The apparatus according to claim 1 additionally comprising a filter screen positioned in said air nozzle adjacent to said at least one exit opening for filtering said air flow prior to exit thereof from said at least one air exit opening.

13. The apparatus according to claim 1 wherein said air nozzle includes one or more adjustably positionable nozzle elements defining said at least one air exit opening.

14. The apparatus according to claim 1 wherein at least a portion of said air nozzle is selectively completely removable from said housing to facilitate access to the interior of said air nozzle.

* * * * *